US005927012A

United States Patent [19]

Cermola et al.

[11] Patent Number: 5,927,012

[45] Date of Patent: Jul. 27, 1999

[54] EMERGENCY RELEASE LATCH MECHANISM FOR SMOKE HATCH

[75] Inventors: Steven G. Cermola, Woodbridge; Won Suk Surh, North Branford, both of Conn.

[73] Assignee: The Bilco Company, West Haven, Conn.

[21] Appl. No.: 09/102,182

[22] Filed: Jun. 22, 1998

[51] Int. Cl.[6] ..... E05B 65/10

[52] U.S. Cl. ..... 49/141; 49/7; 49/366

[58] Field of Search ..... 49/1, 3, 4, 7, 8, 49/141, 366, 367, 379

[56] References Cited

U.S. PATENT DOCUMENTS

| | | | |
|---|---|---|---|
| 2,983,343 | 5/1961 | Lyons . | |
| 3,516,197 | 6/1970 | Lyons . | |
| 3,516,198 | 6/1970 | Lyons . | |
| 3,601,437 | 8/1971 | Lyons | 49/7 |
| 3,830,016 | 8/1974 | Levine | 49/8 |
| 4,090,437 | 5/1978 | Bogaert | 49/8 X |
| 4,517,765 | 5/1985 | Mucha | 49/8 X |
| 5,638,645 | 6/1997 | Lipton | 49/386 X |

OTHER PUBLICATIONS

Bilco's DSH Series Automatic Fire Vents, Data Sheet, 1994.

How to Reset THERMOLATCH™ Control Mechanism with a New Fusible Link, Data Sheet, 1984.

*Primary Examiner*—Jerry Redman

*Attorney, Agent, or Firm*—DeLio & Peterson, LLC

[57] ABSTRACT

An emergency release latch mechanism for a hinged cover of a hatchway construction, wherein the cover is heavily spring biased to open position but is normally restrained in closed position by the latch mechanism. The mechanism includes an emergency-actuated release member such as a low-temperature fusible metal link which, through a release mechanism which reduces the tensile load on the link, retains a latching dog in engagement with a shackle pin on the cover but assures positive disengagement therefrom to release the cover to open position in the event of actuation of the emergency-actuated release member. The latch mechanism is typically positioned at the center of the hatch but the release member and emergency-actuated release members are disposed near a wall of the hatch so that the latch mechanism may easily be set or reset by a person at the periphery of the hatch by securing a cable connecting the latch mechanism and release mechanism.

10 Claims, 4 Drawing Sheets

EMERGENCY RELEASE LATCH MECHANISM FOR SMOKE HATCH

BACKGROUND OF THE INVENTION

1. Field of the Invention

This invention relates in general to a smoke hatch and/or an explosion hatch and an emergency release latch mechanism for use with the hatch, and more particularly to release latch mechanisms for roof-mounted smoke hatches for buildings which hatches can be actuated by fire, pressure such as an explosion, manually and electrically and which, after actuation and opening of the hatch, the hatch may be closed and the release latch mechanism may be easily reset by a person at the periphery or end wall (curb) of the hatch.

2. Description of Related Art

Building smoke hatches are widely used for venting the inside of a building quickly to exhaust smoke or poisonous or explosive gas accumulated resulting from a fire in the building. As a rule, these hatches are not used as an entryway to a building. For safety purposes the cover or covers of the hatch are hinged and are heavily spring loaded to open position in order to effect rapid opening in a fire emergency, not only against their own weight but also against natural restraining forces such as wind or accumulated snow or ice. Since the cover areas are fairly large, the spring loading on the covers must be substantial to overcome these restraining forces. In addition, there are transitory uplift forces caused by wind passing over the covers, so that total door-opening forces may range for example from several hundred to as much as 1000 pounds or more per door in typical installations. Such preloads on the door or cover are opposed in the closed condition of the hatch cover solely by the latch mechanism employed. The unit forces acting in the latching dog and shackle members are accordingly exceedingly high, making it a problem to provide an arrangement which is capable of securely latching the cover in closed condition, yet which requires only a minimum force to effect release upon occurrence of a fire or explosion.

It is common practice in the prior art to effect automatic release of the latch and consequent opening of the hatch cover in case of fire emergency by employing devices incorporating a low melting point fusible metal link which automatically ruptures upon attainment of a predetermined elevated ambient temperature as a result of a fire in the building. Attempts to employ fusible links directly connected to the hatch cover are generally unsatisfactory where, as indicated above, the preload forces on the cover are of such high order which are greater than the strength of the fusible links. The fusible links are made of a low melting or fusing temperature metal to be effective for fire detection purposes but inherently lack the necessary tensile strength to continuously resist the heavy preload forces of the doors in the closed position. Realizing such drawbacks, hatches have been made heretofore to provide an emergency release device which will withstand the high loading on the latch mechanism without adversely affecting the temperature at which it is set to release in case of a building fire. Such a release latch mechanism is shown in U.S. Pat. No. 3,516,198 to Lyons and assigned to the assignee of the present invention and which patent is herein incorporated by reference. The latch mechanism shown in Lyons reduces the unit forces acting on the fusible link or other emergency-actuated release element. These hatches are also made for allowing the hatch cover or covers to open in case of an explosion within the building. These type hatches generally require a multistep latch mechanism resetting procedure performed by a person reaching out over the open hatch to the latch mechanism positioned at the center of the hatch.

Bearing in mind the problems and deficiencies of the prior art, it is therefore an object of the present invention to provide an emergency release latch mechanism for heavily spring biased covers of smoke hatches and the like, which effectively reduces the unit forces acting on an emergency-actuated release element itself, e.g., a fusible link, yet is compact and mechanically simple and certain in operation and which latch mechanism may easily be set or reset after actuation by a person positioned at the periphery of the hatch without having to extend or reach out over the opening.

Another object is to provide a release latch mechanism of the character described which permits manual release of the latch cover without disrupting the fusible link element or other automatic emergency-actuated release member, so that upon reclosing the hatch cover and re-engagement of the latch mechanism, such emergency-actuated release member is again automatically effective.

A further object of the novel latch mechanism here disclosed is to provide a latch mechanism which may be readily operated in tandem with another mechanism of identical construction, both being under the control of a single emergency-actuated release element, where it is desired to employ two or more latch means on the same door or cover, or where the hatch employs a double door each having at least one emergency release latch mechanism.

Another object of the present invention is to provide a smoke hatch employing the emergency release latch mechanism of the invention.

Still other objects and advantages of the invention will in part be obvious and will in part be apparent from the specification.

The invention is illustrated for convenience in the embodiment of a latch mechanism for double doored vent or smoke hatch construction shown in the accompanying drawings.

SUMMARY OF THE INVENTION

An emergency release latch mechanism for a hinged cover of a hatchway, wherein the cover is heavily spring biased to open position but is normally restrained in closed position by said latch mechanism and wherein the said hatchway includes fixed structural members for supporting said cover and for mounting it on an access opening to be served thereby, said emergency release latch mechanism comprising:

- a longitudinally reciprocal bar and bearing means supporting said bar and fixed on a fixed structural member adjacent the underside of said cover at the unhinged edge thereof and permitting reciprocation of said bar upwardly and downwardly in relation to the access opening between extended and retracted positions respectively;
- a latching dog pivotally secured to the upper end of said bar and disposed normally thereby adjacent the underside of said cover, said dog having a hook portion at its free end and being swingable about an opening and means urging said latching dog in a predetermined latching direction;
- a shackle pin secured to the underside of said cover in position for engagement by said hook portion of said latch dog when said cover is closed to maintain said cover closed against its spring bias;
- an offset portion at the lower end of the reciprocal bar constituting a sear;

lever means pivotally supported on a fixed structural member closely adjacent said offset and having a body portion and a leg portion, the leg portion engageable with said sear when the reciprocal bar is in the retracted position and the hatch cover is in normal closed position to prevent upward movement of said reciprocal bar and latching dog; and means connecting the body portion of said lever means preferably to a pivotable release arm structural member through an emergency-actuated release member which release arm is fixed in a non-release position and the emergency-actuated release member prevents pivoting of the release arm; wherein when the release member is actuated the release arm pivots releasing the connecting means so that the body portion of the lever pivots releasing the leg portion from overlying the sear whereby said reciprocal bar and latching dog are free to move upwards towards extended positions under the urging of the spring bias on said cover to permit withdrawal and disengagement of said shackle pin from said hook portion of said dog as said door swings open.

In another aspect of the invention a hatchway is provided wherein the cover is heavily spring biased to open position but is normally restrained in closed position by a latch mechanism and wherein the hatchway includes fixed structural members for supporting said cover and for mounting it on an access opening to be served thereby, said hatchway comprising in combination:

fixed structural members comprising interconnected sidewalls and endwalls both sidewalls and endwalls being typically flat providing a flat or horizontal hatch cover;

a sidewall transverse brace;

a longitudinal channel joining the endwalls;

a longitudinally reciprocal bar and bearing means supporting said bar and fixed on a fixed structural member adjacent the underside of said cover at the unhinged edge thereof and permitting reciprocation of said bar upwardly and downwardly in relation to the access opening between extended and retracted positions respectively;

a latching dog pivotally secured to the upper end of said bar and disposed normally thereby adjacent the underside of said cover, said dog having a hook portion at its free end and being swingable about an opening and means urging said latching dog in a predetermined latching direction;

a shackle pin secured to the underside of said cover in position for engagement by said hook portion of said latch dog when said cover is closed to maintain said cover closed against its spring bias;

an offset portion at the lower end of the reciprocal bar constituting a sear;

lever means pivotally supported on a fixed structural member closely adjacent said offset and having a body portion and a leg portion, the leg portion engageable with said sear when the reciprocal bar is in the retracted position and the hatch cover is in normal closed position to prevent upward movement of said reciprocal bar and latching dog; and means connecting the body portion of said lever means preferably to a pivotable release arm structural member through an emergency-actuated release member which release arm is fixed in a non-release position and the emergency-actuated release member prevents pivoting of the release arm; wherein when the release member is actuated the release arm pivots releasing the connecting means so that the body portion of the lever pivots releasing the leg portion from overlying the sear whereby said reciprocal bar and latching dog are free to move upwards towards extended position under the urging of the spring bias on said cover to permit withdrawal and disengagement of said shackle pin from said hook portion of said dog as said door swings open.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

Description of the Preferred Embodiment(s)

Figure 1:
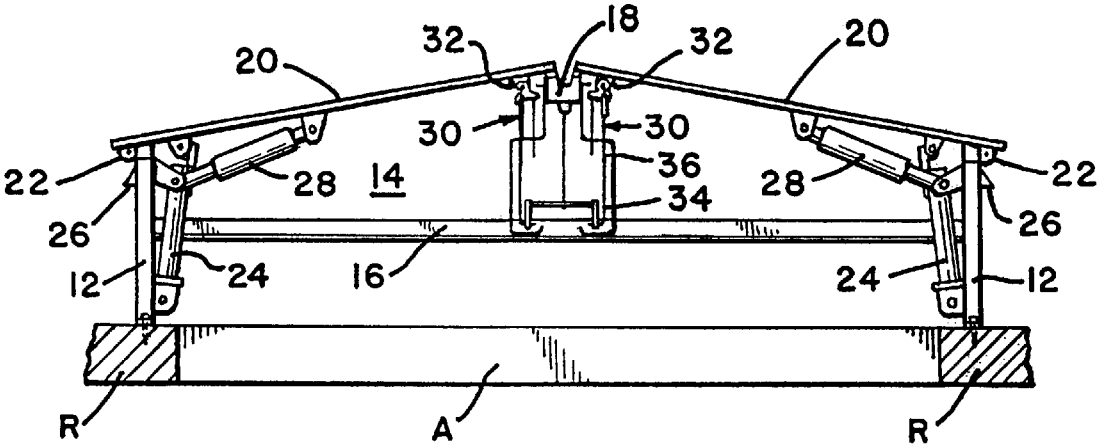
FIG. 1 is an end elevational view of a double-doored gabled smoke hatch incorporating the novel latching mechanism, the hatch being positioned on an access opening in the roof of a building, one end wall of the hatch being removed in the illustration to show the interior construction more clearly.

In describing the preferred embodiment of the present invention, reference will be made herein to FIGS. 1–7B of the drawings in which like numerals refer to like features of the invention. Features of the invention are not necessarily shown to scale in the drawings.

Figure 2:
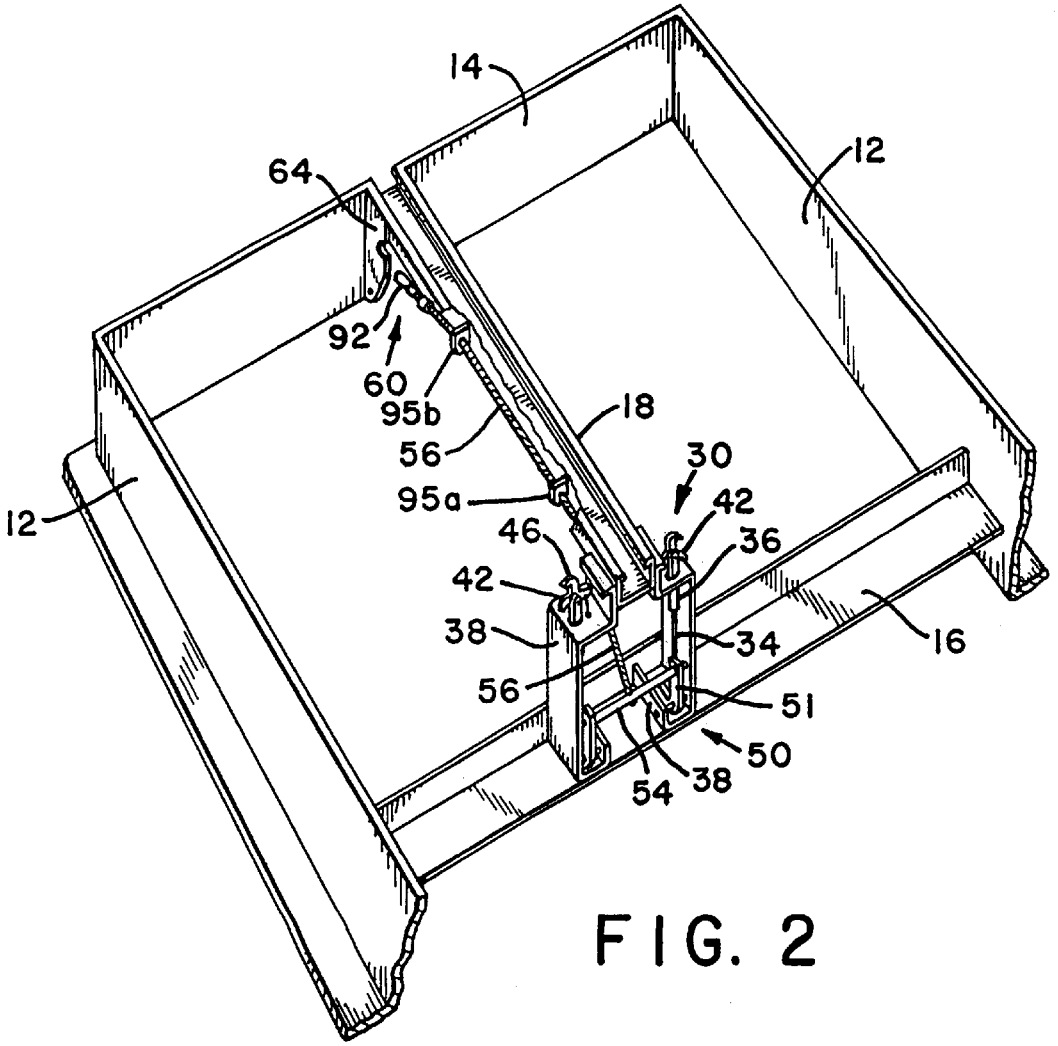
FIG. 2 is a partial perspective view of the latching mechanism of a hatch construction as shown in FIG. 1.

Referring to FIG. 1, a smoke hatch is shown in closed relation to an access opening A in the roof R of a building through which smoke or gases are to be relieved or vented. The hatchway includes the usual fixed structural members comprising interconnected side walls 12 and gabled end walls 14 (of which only the one is shown in FIG. 1). The endwalls 14 are typically flat providing a flat or horizontal cover as shown in FIG. 2. The same latch mechanism and structure applies to both gabled and flat covers. Side walls 12 are braced transversely of the hatch by angle member 16 extending centrally across access opening A in one direction, while end walls 14 are interconnected between their apices by a longitudinal channel 18. The side end walls are bolted or otherwise secured to the roof R in conventional manner around the access opening A.

Mutually closing covers 20 are each hinged along a top edge of a respective side wall 12, as at 22, and swing mutually inwardly and downwardly into closing position relative to the supporting hatch structure and access opening A. In the fully closed condition, the free edges of the covers substantially abut in the trough formed by longitudinal channel 18. The covers are spring biased to open position relative to the hatch structure by sets of compression spring members 24. These are mounted between and secured to the side walls 12 and covers 20 in conventional manner. Depending on the size of the covers, a number of sets of compression members 24 will be employed on each cover in order to give a total opening or lifting force sufficient not only to overcome the weight of the cover but the additional weight of any loading imposed on it by wind forces or accumulated snow or ice. In order to cushion the sudden shock of the covers in arriving at full open position, as when the hinged edges of the covers swing back against stop members 26 fastened to the side walls 12 of the hatch structure, it is conventional to provide shock absorbers 28 which are also shown attached to and extend between the side walls 12 and covers 20 in known manner. The shock absorbers are now typically attached to angle member 16 and cover 20 but the same shock absorbing effect is provided.

In order to retain the covers 20 in closed position against the opening force of compression spring members 24, as shown in FIG. 1, each cover is provided with latching means at its free or unhinged edge. Such means comprise a latch mechanism indicated generally as 30 suitably secured to fixed structural members of the hatch and a cooperating shackle arrangement 32 mounted on the underside of the respective covers 20. A reciprocating bar 34 which moves in a sleeve or bearing 36 forms part of the latch mechanism 30 which cooperates with a latch release mechanism to open and close covers 20.

Since the latch mechanism means is identical for each of the two covers, only one such latch mechanism 30 and cooperating shackle 32 and latch release mechanism will be described herein, it being understood that the other is merely a duplication of the first.

Figure 3:
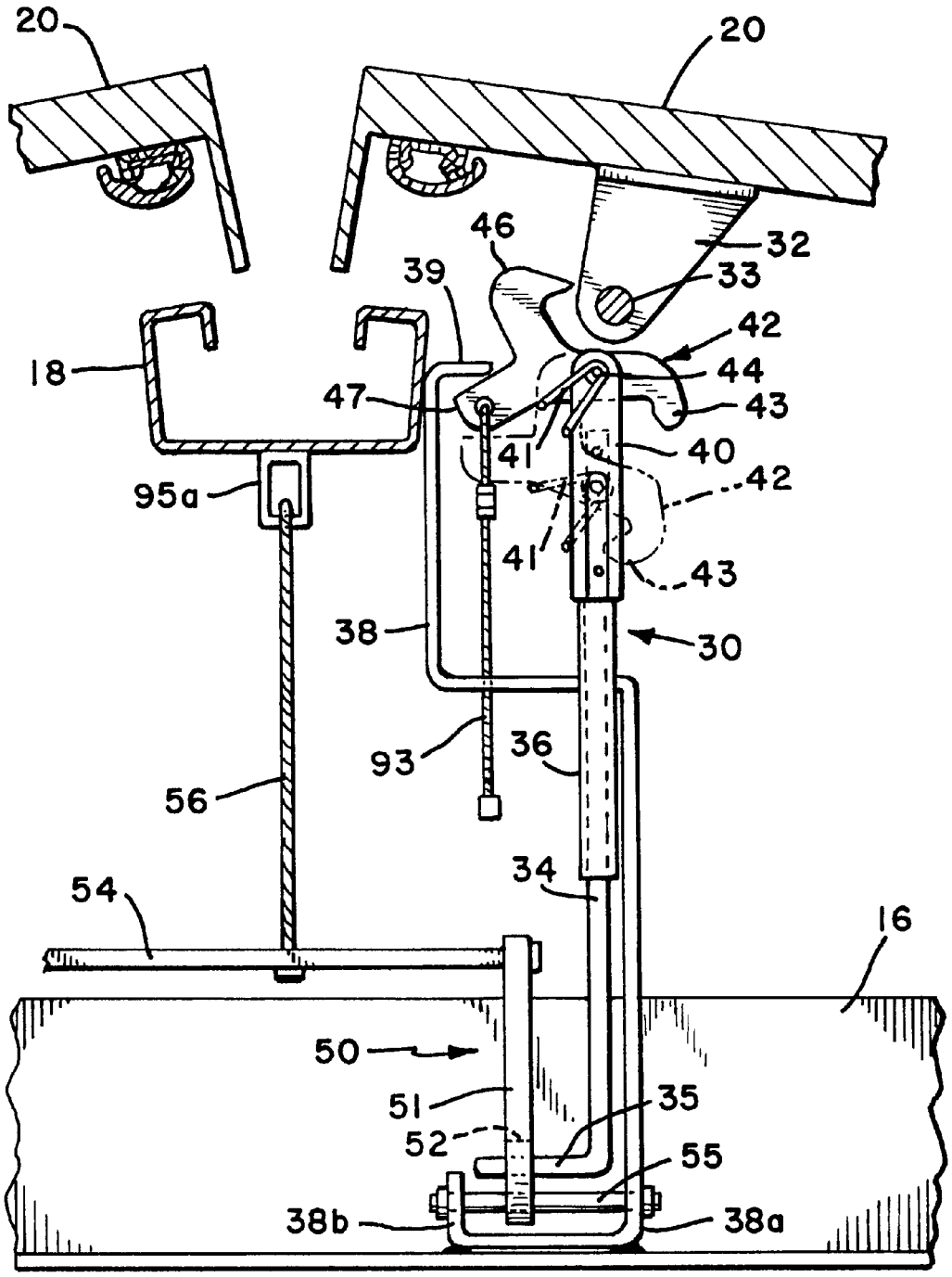
FIG. 3 is a view similar to that of FIG. 1 but with parts shown in actuated or released position of the latch.

Referring to FIGS. 2 and 3, the latch mechanism 30 comprises an upward and downward moving reciprocal bar 34 which is supported for sliding movement in a sleeve or bearing 36, the latter being welded or otherwise secured to a generally S-shaped structural brace 38 which extends from longitudinal channel member 18 downwardly to the vertical and horizontal webs of the transverse angle member 16. The S-shaped structural brace 38 is suitably secured to the channel member 18 and angle member 16, as by welding. A cable 56 is shown extending from connecting bar 54 to a release arm 60 through cable guides 95*a* and 95*b*. The release arm 60 is supported by bracket 64. As can be seen in FIG. 2, the cable 56 is preferably prevented from moving past cable guide 95*b* when cable hook 92 is larger than the opening in guide 95*b*. This restrains the end of the cable to a position near the endwall 14 allowing a person to easily reset the latch mechanism without reaching over the hatch opening.

As shown in FIG. 3, reciprocal bar 34 has a clevis 40 secured to its upper end, and a latching dog 42 is pivotally mounted in the clevis by a pin 44 extending between the legs thereof. Dog 42 is roughly S-shaped and is pivotally supported by the clevis pin near its center for rocking motion in a vertical plane, whereby to move the upper hook portion 46 into and out of latching engagement with a generally horizontally extending shackle pin 33 carried by shackle member 32 on cover 20. The hook portion 46 of the latching dog 42 is so designed that when fully engaged with shackle pin 33 in the closed position of door 20, dog 42 is in over-center condition relative to the center line drawn between its pivot pin 44 and shackle pin 33, whereby the upward or opening force exerted by door 20 on the latching dog tends to rotate about pin 44 in a clockwise direction, as viewed in FIG. 3, thereby reinforcing engagement of the hook portion 46 and shackle pin 33. In the latched condition shown in FIG. 1, reciprocal bar 34 is held in its downwardly or retracted position relative to sleeve 36 by a latch release mechanism which will presently be described, whereby cover 20 is prevented from swinging upwardly toward open position.

Figure 4A:
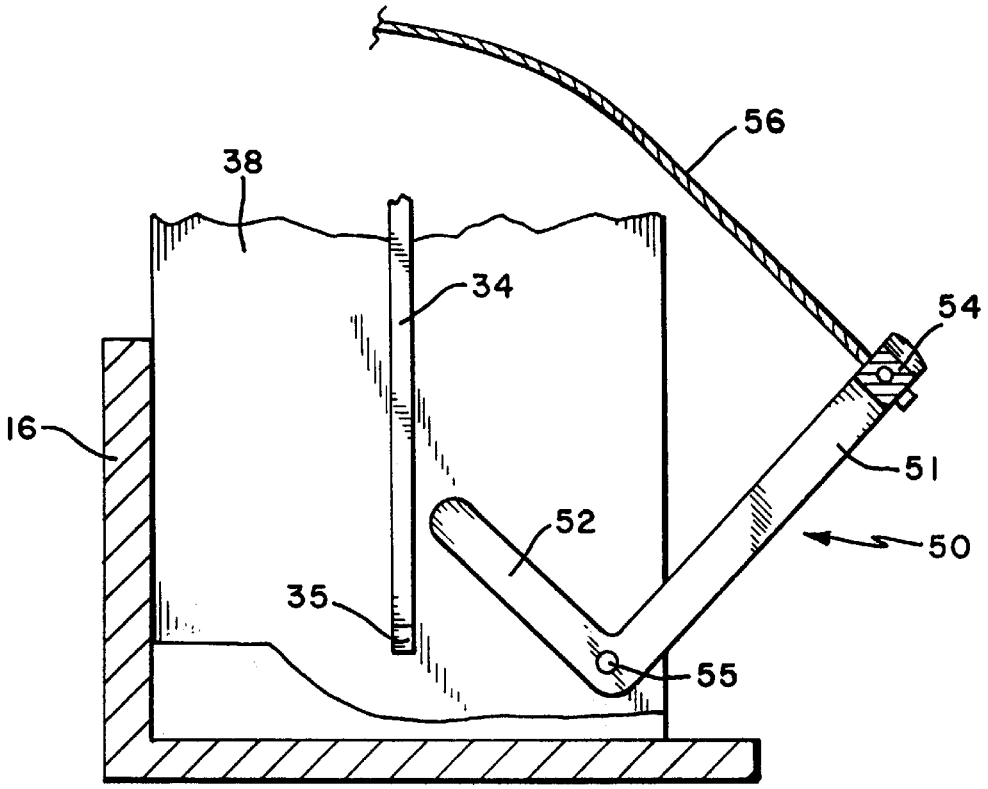
FIGS. 4A and 4B are side elevational views of the mechanism shown in FIGS. 2 and 3 used to secure and release the latch member in the released and locked portions, respectively.
Figure 4B:
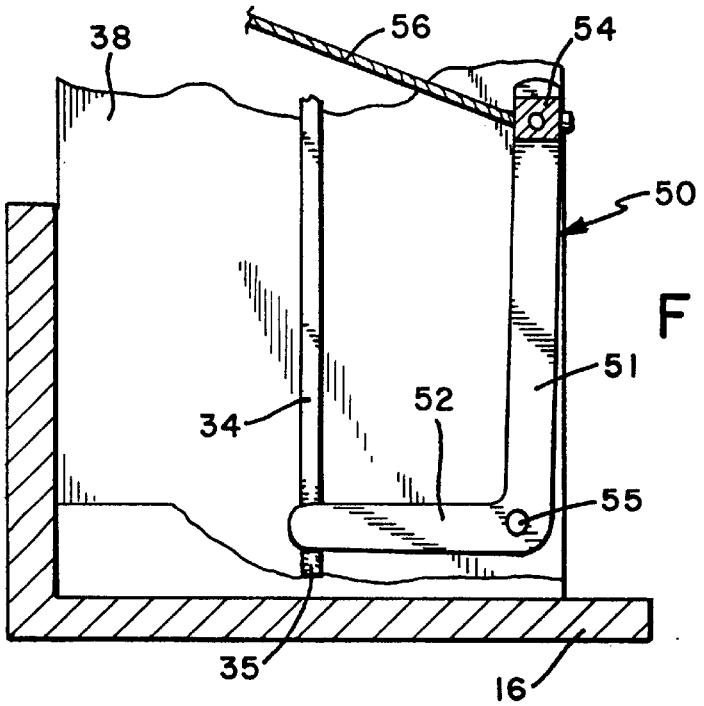

Referring now to FIGS. 3, 4A and 4B, the means for restraining reciprocal bar 34 in the aforesaid downwardly retracted position for locking shackle 32 is effected in the following manner. At its lower end, bar 34 is formed with a bend or offset 35 constituting a sear. A restraining lever, shown generally as 50, is of an L-shaped configuration having a body portion 51 terminating in an extending preferably transverse shorter leg portion 52. The lever 50 is pivotally supported at the juncture of the body and leg portions from structural brace 38 by pin 55 extending between vertical lower portions 38*a* and 38*b* of brace 38. Leg 52 can therefore be moved (pivoted) downward to overlie sear 35 of reciprocal bar 34 and prevent upward movement of the bar 34 as shown in FIG. 4B or leg 52 can be pivoted upward so that sear 35 and bar 34 can move freely up and down as shown in FIG. 4A.

As mentioned above, the foregoing latch mechanism construction is duplicated for the other cover. Accordingly there are two restraining levers 50 to control movement of each reciprocal bar and the respective latch mechanisms. Preferably, as shown in FIG. 3, a connecting bar 54 is rotatably connected to the upper ends of body portion 51 of each lever 50 to move both levers 50 with one motion as described below. Thus, cable 56 is secured at one end to a central portion of connecting bar 54 and at the other end to a release mechanism structure shown generally as 59 in FIGS. 5A and 5B. When the other end of the cable 56 is secured by release mechanism structure 59, the connecting bar 54 is pulled forward toward the release mechanism structure 59 and leg 52 of restraining lever 50 is pivoted downward to overly sear 35 of reciprocating bar 34. When the cable is released by the release mechanism structure in the event of a fire, explosion, etc., the connecting bar is released and is forced backwardly disengaging leg 52 from overlying sear 35 freeing reciprocating bar 34 for upward extended movement and releasing the latch mechanism and opening the cover.

Figure 5A:
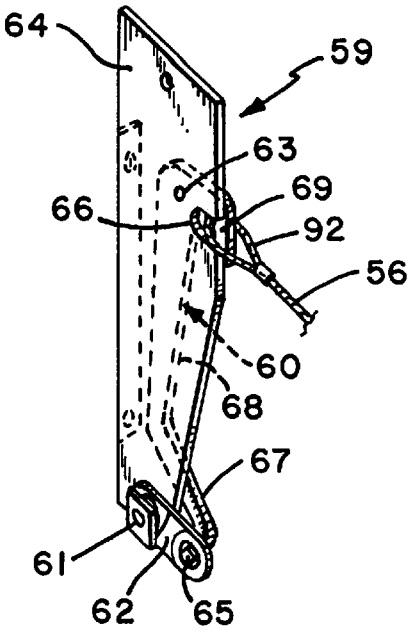
FIG. 5A shows in perspective the bracket used at the end wall to support the fusible link and the cable release arm.
Figure 5B:
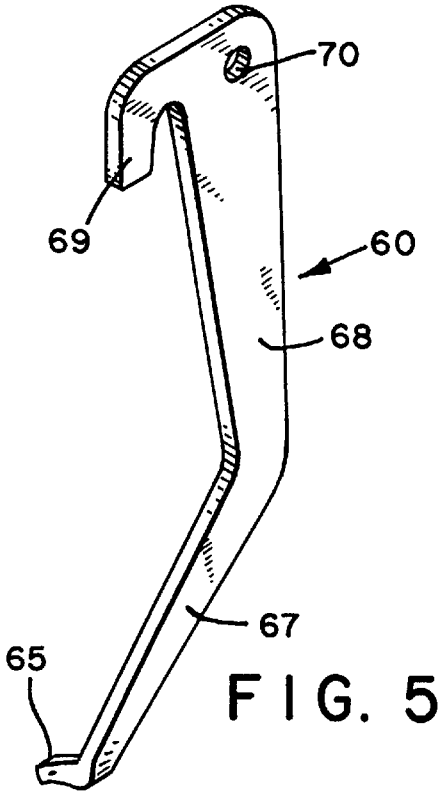
FIG. 5B shows in perspective the cable release arm of FIG. 5A.

As shown in FIGS. 5A and 5B, fusible metal link 62 is connected at one end to bracket 64 of release mechanism structure 59 by a pin 61 and to the free end 65 of release arm 60. The release arm 60 is pivotally mounted by pin 63 to bracket 64. Bracket 64 is preferably mounted to longitudinal channel 18 near the end wall 14 and/or to end wall 14 as shown in FIG. 2. The fusible link 62 is designed to rupture or fail under a given tensile load at a predetermined ambient temperature and constitutes an emergency-actuated release member setting the emergency release latch mechanism in operation. The end of cable 56 is shown in the form of a loop 92 which is held by hook 69 of release arm 60 in an opening 66 of the bracket which cooperates with hook 69 of release arm 60. When the fuselink 62 fails, release arm 60 is forced to pivot upward by the tension on cable 56 raising hook 69 upward and exposing opening 66 and releasing the cable 56. The reciprocal bar 34 of the latch mechanism as described hereinabove is also released and the cover opened.

Referring to FIG. 5B, a preferred release arm shown generally as 60 is used with a bracket as shown in FIG. 5A to secure both the cable 56 and fusible link 62 when the hatch covers are closed. The release arm 60 is of an arcuate, elongated planar shape having an upper portion 68, a lower portion 67, a hook 69 at the upper portion, and an outward extending leg portion 65. An opening 70 is provided at the upper end thereof for pivotal movement of the release arm 60 as shown in FIG. 5A by use of pin 63.

As will be seen from the foregoing description, the opening force imposed on a cover 20 by the compression spring means 24 is resisted in the latched condition of latch mechanism 30 by bracket 64 and pivotally connected release arm 60 restraining movement of cable 56 secured to the release arm and bracket. Cable 56 is under tension holding leg 52 of restraining lever 50 over the sear 35 of reciprocal bar 34 which is in a retracted position. In this position, the latching dog 42 is in positive engagement with shackle 32 of the door. However, upon rupture of the fusible link 62, cable 56 is released from release mechanism structure 59 and connecting bar 54 is freed and swings downward by gravity and the upward force of covers 20 acting through reciprocating bar 34 to the position shown in FIG. 4A, thereby allowing reciprocating bar to move upward disengaging latching dog 42. This upward movement of reciprocating bar 34 allows cover 20 to start swinging movement towards open position, in the course of which the arcuate movement of shackle pin 33 moves that pin laterally so that the bearing contact of hook 46 with pin 33 is no longer in over-center position relative to pivot 44. When this condition is reached, latching dog 42 will rotate counterclockwise, as seen in FIG. 3, to effect disengagement of the hook portion 46 and shackle pin 33. As soon as such disengagement is effected, door 20 will of course be free to swing to its fully open position under the urging of compression spring members 24.

As shown in FIG. 3, in order to provide a more positive and assured disengagement of hook portion 46 and shackle pin 33, latching dog 42 is formed with an arm 47 extending generally oppositely of hook portion 46. As latching dog 42 moves upwardly upon release of reciprocal bar 34, arm 47 of the dog strikes the horizontally projecting upper leg 39 of brace 38 so that continued upward movement of the dog causes positive counterclockwise pivotal movement about pin 44 on bar 34, thus positively effecting the release of the shackle pin.

In order to provide manual release of the latch, a cable 93 is connected to latching dog 42, and arm 47 provides a convenient point of attachment so that when the cable 93 is pulled vertically downward, dog 42 is pivoted out of latching engagement, without any vertical reciprocation of bar 34, releasing the door to swing open without disturbing the emergency release system under the control of the fusible link 62. If it is then desired to reclose the door, this can be accomplished by forcing it downwardly against the spring loading forces until shackle pin 33 again engages hook portion 46 of the latch. In order to facilitate this, hook portion 46 is suitably contoured on its upper end to provide a camming surface which, upon engagement by shackle pin 33, temporarily causes dog 42 to pivot counterclockwise until the pin 33 passes under the lip of the hook. In order, then to assume positive re-engagement of the hook, a torsion spring 41 is provided on clevis 40 which bears against arm 47 of dog 42, biasing it in clockwise or shackle-pin-engaging position. To prevent overtravel in that direction when the dog is not in engagement with shackle pin 33, the lower leg 43 of dog 42 is formed to provide a stop which abuts the upper end of reciprocal rod 34 within the legs of clevis 40.

Where a double-doored hatch and double latch mechanism is employed, the manual release effected by cable 93 can be paralleled by suitable yoke means and a single cable run from the yoke to any desired location using suitable sheaves for guiding the cable around corners and the like.

With reference to the latch mechanism and release mechanism, the latch mechanism is secured in the cover closed portion by cooperating restraining lever 50 and cable connected release mechanism structure 59 including pivotally connected release arm 60. As can be seen from FIGS. 4A and 4B, lever 50 provides a mechanical advantage force effect on sear 35 proportional to the length of body portion 51 of lever 50. Thus, the longer body portion 51, the more mechanical advantage and less force required to hold sear 35 and reciprocating bar in the closed cover position. If the body portion 51 is sufficiently long, the tension on cable 56 will be sufficiently reduced so that the end of the cable 56 can be secured directly to a fusible link at the endwall or other portion of the hatch. This may not be practical, however, and it is preferred that a release mechanism structure 59 including cooperating release arm 60 be used in concert with lever 50. Release arm 60 also provides a mechanical advantage proportional to the length of body portions 67 and 68 thereof and decreases the tension forces on the fusible link 62.

Figure 6:
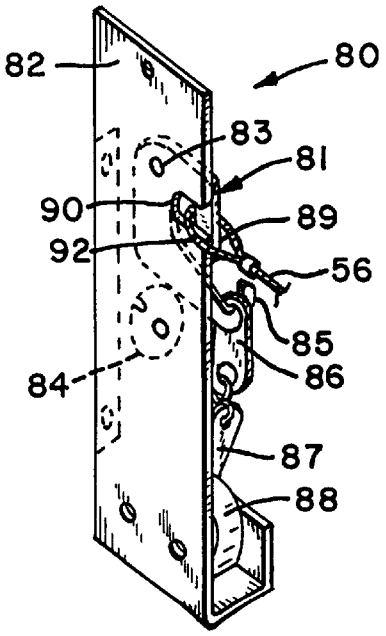
FIG. 6 shows a perspective view of another embodiment of a bracket which supports a release arm and a fusible link which is set at a desired latch mechanism actuating pressure.

With reference to FIG. 6, a pressure sensitive cable release mechanism structure is shown generally as 80. A release arm 81 is generally planar in a C-shape and is pivotally mounted to bracket 82 by pin 83. The release arm 81 has a hook 89 at one end and an outwardly extending leg 85 at the other end. If the release arm 81 is pivoted upward, hook 89 moves upward and bracket opening 90 is exposed. The end 92 of cable 56 is restrained in opening 90 by hook 89 when the release arm is in the downward position as shown in FIG. 6. As shown, leg 85 engages one end of a link 86, which is preferably a fusible link, with the other end of the link being engaged with the lead end 87 of a constant force spring 88. When a cable is secured to the bracket in opening 90, the force required to release the cable can be adjusted to a desired sensitivity preferably by rotating cam 84 which abuts release arm 81 and which rotates release arm 81 about pin 83 to provide the desired cable sensitivity. Facing the cam 84, when the cam is rotated clockwise, the force required to release the cable is increased. Conversely, when the cam is rotated counter-clockwise, tension in the cable is reduced. In the embodiment shown in FIG. 6, the release mechanism structure 80 will be actuated by pressure, heat or a combination thereof. Thus, if the fusible link 86 is melted, the cable is released. Likewise, if the hatch pressure is exceeded, the cable will be released due to the restraining force of the spring being exceeded.

Figure 7A:
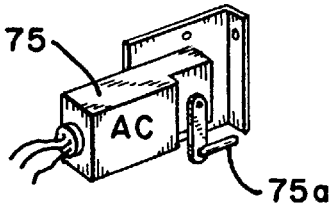
FIG. 7A and 7B show electrically actuated devices to release the release arm supported by a bracket and allow the release arm to pivot and the cable connecting means to release opening the hatch.
Figure 7B:
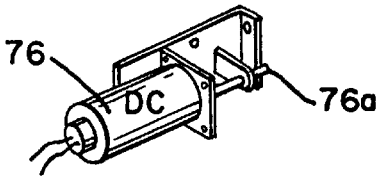

In place of a fusible metal link, such as link 62 shown in FIG. 5A, other emergency-actuated release means can be employed, as for example a solenoid-operated latching bolt which normally restrains the free end of release arm 60 such as 65 in FIG. 5A. Such an arrangement is shown in FIGS. 7A and 7B wherein a torque box 75 and solenoid 76 are provided with armature pins 75*a* and 76*a* normally engaging the free end of release arm 60. The solenoids 75 and 76 are energized to withdraw armature pins 75*a* and 76*a* under the control of some suitable sensor device such as a photoelectric cell, capacitance-operated switch, or bimetallic heat-operated switch, of standard known construction located in an appropriate position in the building to be protected thereby. The sensor device may also be adapted for operation by pressure, rather than heat and/or smoke, where it is desired to cause the hatch doors to open in case of an explosion occurring in the building. It will be apparent too that sensor devices of both types, i.e., heat and/or smoke and pressure, may be employed together in an installation by paralleling the devices in the control circuit of solenoids 75 and 76.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An emergency release latch mechanism for a hinged cover of a hatchway, wherein the cover having an upperside and an underside and an opposed unhinged edge is heavily spring biased to open position but is normally restrained in closed position by said latch mechanism and wherein the said hatchway includes fixed structural members for supporting said cover and for mounting it on an access opening to be served thereby, said emergency release latch mechanism comprising:

a longitudinally reciprocal bar having an upper end and a lower end, and bearing means supporting said bar on a fixed structural member adjacent the underside of said cover at the unhinged edge thereof and permitting reciprocation of said bar between extended and retracted position respectively upwardly and downwardly in relation to the access opening;

a latching dog pivotally secured to the upper end of said bar and disposed normally thereby adjacent the underside of said cover, said latching dog having a hook portion at its free end and being swingable about an opening and means urging said latching dog in a predetermined latching direction;

a shackle pin secured to the underside of said cover in position for engagement by said hook portion of said latching dog when said cover is closed to maintain said cover closed against its spring bias;

an offset portion on said reciprocal bar constituting a sear, and lever means pivotally supported on a fixed structural member closely adjacent said offset portion and having a body portion and a leg portion, the leg portion engageable with said sear in normal closed position of said cover and said latching dog to prevent upward movement of said reciprocal bar and said latching dog; and means connecting the body portion of said lever means to a pivotable release arm structural member through an emergency-actuated release member which release arm is fixed in a non-release position; wherein when the release member is actuated the release arm pivots releasing the connecting means so that the body portion of the lever pivots releasing the leg portion from overlying the sear whereby said reciprocal bar and said latching dog are free to move upwards towards extended position under the urging of the spring bias on said cover to permit withdrawal and disengagement of said shackle pin from said hook portion of said latching dog as said door swings open.

2. The emergency release latch mechanism as defined in claim 1, wherein said latching dog has an arm portion extending generally oppositely of said hook portion, and said latch mechanism includes a fixed abutment member disposed for engagement of said arm portion of said latching dog as the latter is moved to its extended position to cause positive pivotal movement and disengagement of said hook portion from said shackle pin, said fixed abutment being spaced from said arm portion of said latching dog in the retracted position of the latter.

3. The emergency release latch mechanism as defined in claim 1 for use in a hatchway construction having a pair of hinged covers, wherein said latch mechanism includes duplicate sets of said reciprocal bar, pivotable latching dog and lever means with one such set being disposed for engagement by the respective latching dogs; said lever means being pivotally connected to a bar to which the connecting means is attached whereby simultaneous release to the extended position of said latching dogs on pivotal movement of said lever when released by said emergency-actuated release member.

4. The emergency release latch mechanism as defined in claim 1, wherein said emergency-actuated release member comprises a low-temperature fusible metal link.

5. The emergency release latch mechanism as defined in claim 1, wherein said emergency-actuated release member comprises a remotely controlled operated latching pin.

6. The emergency release latch mechanism as defined in claim 1, which further includes cable means connected to said latching dog to effect pivoting thereof manually from a remote position and release of said shackle pin by said latching dog.

7. The emergency release latch mechanism as defined in claim 1, wherein the leg of the release arm is connected to one end of an emergency-actuated release member with the other end of the emergency actuated release member connected to a constant force spring whereby the connecting means is released from the release arm by a force higher than the pressure exerted on the connecting means by the constant force spring or the emergency actuated release member is actuated.

8. The emergency release latch mechanism as defined in claim 1 wherein the leg of the release arm is connected to a constant force spring wherein the connecting means is released from the release arm by a pressure on the connecting means higher than the pressure exerted on the connecting means by the constant force spring.

9. The emergency release latch mechanism as defined in claim 8 wherein the position of the release arm is controlled by a cam.

10. A hatchway wherein a hinged cover having an upperside and an underside and an opposed unhinged edge is heavily spring biased to open position but is normally restrained in closed position by a latch mechanism and wherein the hatchway includes fixed structural members for supporting said cover and for mounting it on an access opening to be served thereby, said hatchway comprising in combination:

fixed structural members comprising interconnected sidewalls and endwalls;

a sidewall transverse brace;

a longitudinal channel joining the endwalls;

a longitudinally reciprocal bar having an upper end and a lower end and bearing means supporting said bar and fixed on a fixed structural member adjacent the underside of said cover at the unhinged edge thereof and permitting reciprocation of said bar upwardly and downwardly in relation to the access opening between extended and retracted positions respectively;

a latching dog pivotally secured to the upper end of said bar and disposed normally thereby adjacent the underside of said cover, said latching dog having a hook portion at its free end and being swingable about an opening and means urging said latching dog in a predetermined latching direction;

a shackle pin secured to the underside of said cover in position for engagement by said hook portion of said latching dog when said cover is closed to maintain said cover closed against its spring bias;

an offset portion at the lower end of the reciprocal bar constituting a sear;

lever means pivotally supported on a fixed structural member closely adjacent said offset and having a body portion and a leg portion, the leg portion engageable with said sear when the reciprocal bar is in the retracted position and the hatch cover is in normal closed position to prevent upward movement of said reciprocal bar and said latching dog; and means connecting the body portion of said lever means to a pivotable release arm structural member through an emergency-actuated release member which release arm is fixed in a non-release position and the emergency-actuated release member prevents pivoting of the release arm; wherein when the release member is actuated the release arm pivots releasing the connecting means so that the body portion of the lever pivots releasing the leg portion from overlying the sear whereby said reciprocal bar and said latching dog are free to move upwards towards extended position under the urging of the spring bias on said cover to permit withdrawal and disengagement of said shackle pin from said hook portion of said latching dog as said door swings open.

* * * * *